US006390958B1

(12) United States Patent
Chu

(10) Patent No.: US 6,390,958 B1
(45) Date of Patent: May 21, 2002

(54) KICK BAG

(75) Inventor: Yong S. Chu, Van Nuys, CA (US)

(73) Assignee: Fitness Botics, Inc., Van Nuys, CA (US)

( * ) Notice: Subject to any disclaimer, the term of this patent is extended or adjusted under 35 U.S.C. 154(b) by 0 days.

(21) Appl. No.: 09/611,191

(22) Filed: Jul. 6, 2000

(51) Int. Cl.[7] ..... A63B 69/30
(52) U.S. Cl. ..... 482/90; 482/83; 482/85
(58) Field of Search ..... 482/83–90

(56) References Cited

U.S. PATENT DOCUMENTS

| | | | | |
|---|---|---|---|---|
| 4,486,016 A | | 12/1984 | Herbert | |
| 4,903,966 A | | 2/1990 | Leon | |
| 5,330,403 A | | 7/1994 | Kuo | |
| 5,437,590 A | | 8/1995 | D'Alto | |
| 5,624,358 A | | 4/1997 | Hestilow | |
| 5,674,157 A | | 10/1997 | Wilkinson | |
| D409,570 S | | 5/1999 | Kuo | |
| 5,941,801 A | | 8/1999 | D'Alto | |
| 6,080,089 A | * | 6/2000 | Nicholson | 482/90 |
| 6,110,079 A | * | 8/2000 | Luedke et al. | 482/83 |
| 6,183,399 B1 | * | 2/2001 | Chen | 482/90 |

* cited by examiner

*Primary Examiner*—Glenn E. Richman
(74) *Attorney, Agent, or Firm*—Gene Scott-Patent Law & Venture Group

(57) ABSTRACT

An apparatus for kick boxing training or punching, the apparatus comprising: a base portion providing a way of increasing the weight of the base portion; an upright portion removably and fixedly engagable with the base portion; and a cushion portion removably engagable with the upright portion and positioned for receiving hand and foot blows from an upright boxer. The base portion provides a circular base plate for resting the apparatus on a surface, and a circular sidewall, the sidewall joining the base plate in an outside radiused peripheral edge. The outside radiused peripheral edge is enabled such that a blow received by the cushion portion causes the apparatus to rotate about the radiused peripheral edge and to thereafter right itself.

9 Claims, 5 Drawing Sheets

KICK BAG

BACKGROUND OF THE INVENTION

1. Field of the Invention

This invention relates generally to exercise devices, and more particularly to a device that is to be kicked or punched as a form of exercise.

2. Description of Related Art

The following art defines the present state of this field: D'Alto, et. al. U.S. Pat. No. 5,437,590 An improved exercise bag that freely allows a person to throw all variations of punches and kicks in combination. The flexibility is made possible by the internal structure of the bag and allows for a reaction of the directed punch or kick. Therefore, the bag has the ability to provide a person with a follow through, if so desired. Furthermore, the bag's design allows for the placement of a variation of punches and kicks. Uniquely, the bag incorporates multiple uses of equipment into one bag. The bag is free standing, enabling a person to exercise 360 degrees around the bag. Furthermore, the bag may also be made adjustable in height.

Hestilow, et. al. U.S. Pat. No. 5,624,358 A training bag apparatus includes a fluid-fillable stand having a pedestal and column supporting a striking pad assembly. The column has a fill opening for filling and emptying the stand. A cap provided to seal the fill opening includes a needle valve for pressurizing the stand. The column of the stand has a pair of channels and lock slots for setting the striking pad assembly to various heights. The striking pad assembly includes a sleeve, a pad disposed around the sleeve and a cover surrounding the exterior of the sleeve and pad. A pair of buttons protrude from the inside wall of the sleeve at locations corresponding to the position of the channels of the column. The sleeve buttons, channels and lock slots cooperate to secure the striking pad assembly at the desired height setting on the column.

Liao, et. al. U.S. Pat. No. 4,903,966 A device for batting and striking practice having a base assembly to provide a firm support. The base assembly has a threaded hole for receiving a lower tube. A sleeve encompasses a set of packing rings, and an intermediate tube constitutes a height adjusting mechanism. The intermediate tube engages with a spring and a protective housing, which in turn engages with an upper tube. A variety of batting or striking bodies may be mounted on and engage with the spring.

Kuo, et. al. U.S. Pat. No. 5,330,403 A punching device includes an inflatable cylinder-shaped bag which serves as a punching bag when inflated, and a hollow casing which is filled with sand or water and which supports the cylinder-shaped bag resiliently and vertically thereon.

D'Alto, et. al. U.S. Pat. No 5,941,801 An improved exercise bag that freely allows a person to throw all variations of punches and kicks in combination. The flexibility is made possible by the internal structure of the bag, and allows for a reaction of the directed punch or kick. Therefore, the bag has the ability to provide a person with a follow through, if so desired. Furthermore, the bag's design allows for the placement of a variation of punches and kicks. Uniquely, the bag incorporates multiple uses. The bag is free standing, enabling a person to exercise 360 degrees around the bag. Furthermore, the bag may also be made adjustable in height.

Rubin, et. al. U.S. Pat. No. 4,486,016 An improved toy punching bag support construction to substantially increase the utility of the toy to the user. Its base support is hollow and can be filled via removable plug with sand or water to significantly increase the weight of the support. The added weight allows the user to punch and circle the bag without having to stand in a stationary position on a support base to secure the bag. A flexible vertical rod has an upper end connected to the bottom end of the bag. The lower end of the rod is adjustably mounted in a pipe. The pipe extends into a sleeve and is fixed relative to the sleeve by a threaded nut at the bottom and a welded stop at the top. The sleeve extends vertically through the base support and has upper and lower shoulders spaced inwardly from the top and bottom walls of the base support.

Kuo, et. al. U.S. Pat. No. D409,670. The ornamental design for a punching bag, showing a rounded base and a cushion on top of a vertical member.

The prior art teaches various punching and kicking bags, some having hollow bases, as does the present invention, that can accept a ballast. However, none of the prior art references teach a punching and kicking apparatus with a hollow base that can accept a ballast, where the base and punching bag are connected in a rigid manner so that they both move in response to a punch or kick, and including a restrainer portion within which the base can rotate when the apparatus is punched or kicked. The present invention fulfills these needs and provides further related advantages as described in the following summary.

SUMMARY OF THE INVENTION

The present invention teaches certain benefits in construction and use which give rise to the objectives described below.

The present invention is an apparatus to be used as a punching or kicking bag or for kick boxing training. The apparatus includes a base that can accept sand or another ballast to further weight the base. The apparatus also includes an upright tube that can be attached and disattached from the base and a cushion positioned upright for being kicked or punched. The cushion can be attached and disattached from the upright tube. The base includes a circular base plate for resting the apparatus on a surface such as a gym floor, and a circular sidewall. The sidewall is joined to the base plate at an outside peripheral edge. When the user hits or kicks the cushion, the entire apparatus rotates, or tilts up so that only a portion of the outside peripheral edge is touching the floor surface. The shape and weight of the base and the outside peripheral edge cause the apparatus to right itself after a blow has been received.

A primary objective of the present invention is to provide an apparatus having advantages not taught by the prior art.

Another objective is to provide such an apparatus capable of remaining rigid so that when a user kicks or punches the bag, the resistance he or she feels is from the weight of the entire bag, including the filling material inside of a container base.

A further objective is to provide such an apparatus capable of remaining rigid so that no flexible points exist between the base and cushion portions that can break, leak, or otherwise deteriorate.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
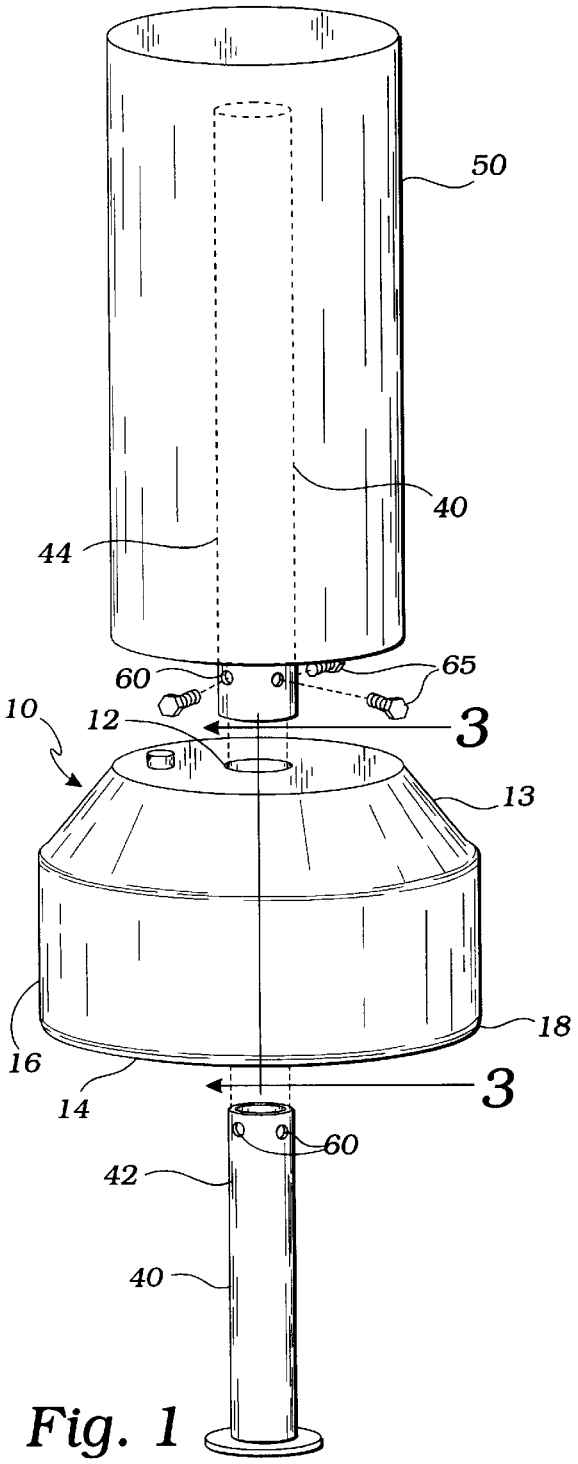
FIG. 1 is a perspective, exploded view of the preferred embodiment of the present invention showing an interior view of the upper portion of an elongate tube encased within a cushion.
Figure 2:
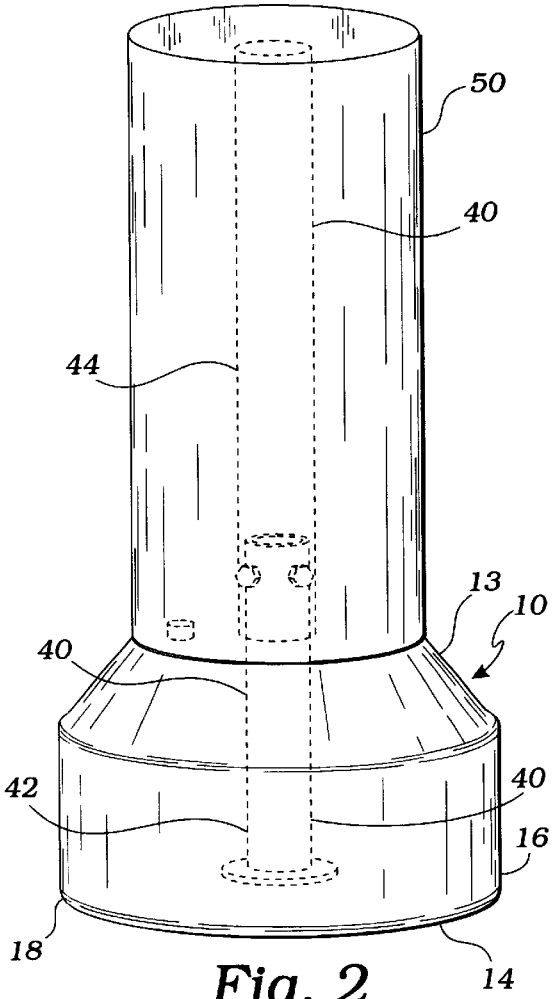
FIG. 2 is similar to FIG. 1 and shows the apparatus assembled, with an interior view of upper and lower members comprising an elongate tube.
Figure 3:
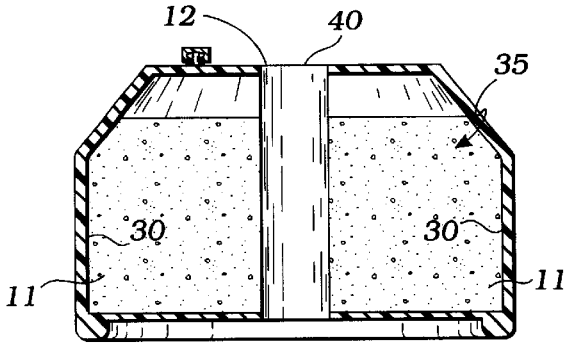
FIG. 3 is a sectional view along the plane shown in FIG. 1.
Figure 4:
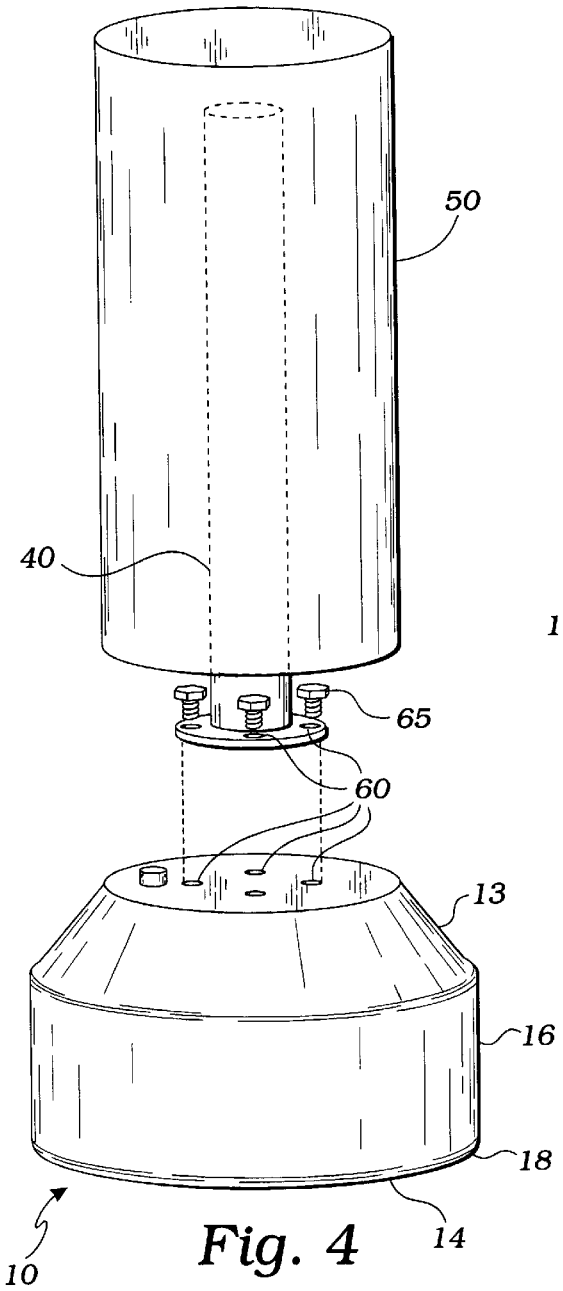
FIG. 4 shows an exploded perspective view of a second embodiment of the invention, with the elongate tube comprised of a single upright member, and a fastening means.
Figure 5:
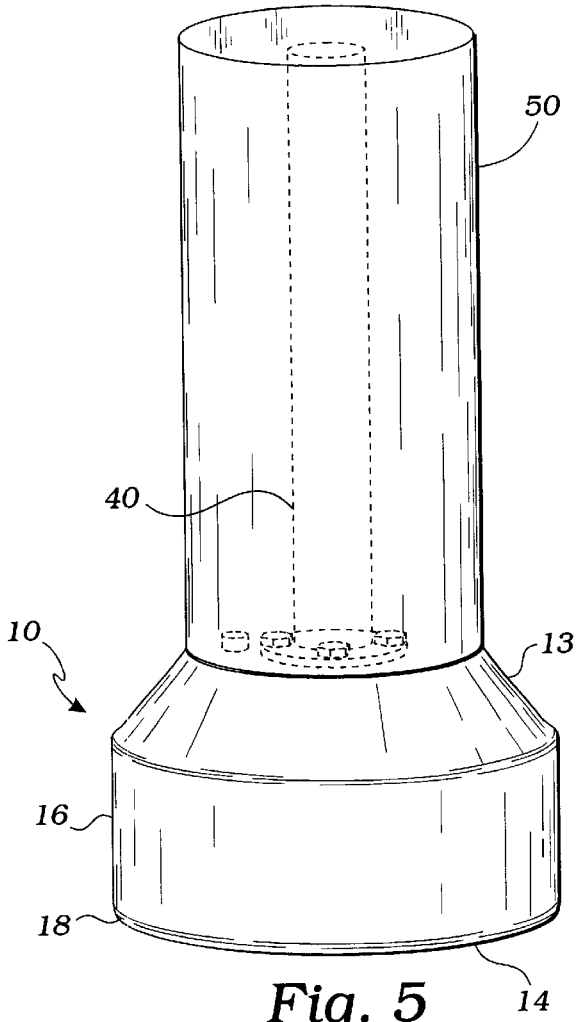
FIG. 5 is similar to FIG. 4 and shows the apparatus assembled.

The above described drawing FIGS. 1–14 illustrate the invention, an apparatus for kick boxing training, the apparatus comprising: a base portion 10, preferably of a plastic such as polypropylene for flexibility, or nylon or polycarbonate, providing a means for accepting a ballast 11 to increase the weight of the base portion 10. Preferably, the base portion 10 is circular, with a top plate 12 sloping upwardly at approximately a 45 degree angle, as shown in FIGS. 1–6, and of a diameter and height to contain the ballast 11. Preferably, the means for accepting a ballast 11 to increase the weight of the base portion. 10 is a base portion interior surface 30 defining a storage space 35 for receiving the ballast 11. The ballast 11 is preferably comprised of sand or water, and is retained in the base portion 10 by means of a plug as is commonly known, placed on the top of the base portion 10. The apparatus further comprises an upright portion 40 removably and fixedly engagable with the base portion 10. The upright portion 40 is comprised of a rigid, marginally flexible material such as polypropylene. The upright portion 40 interior space may be open or closed. Preferably, the upright portion 40 comprises both a lower member 42 adapted for engaging a through hole 12 in the base portion 10 for engagement therewith, and an upper member 44 engaged with the lower member 42 for providing a vertical extension, as shown in FIGS. 1, 2. In another embodiment of the invention, the upright portion 40 comprises a single elongate member adapted for engaging the through hole 12 in the base portion 10 for engagement therewith, and further adapted for extending vertically above the base portion 10 for receiving a cushion portion 50, as shown in FIGS. 4–14.

In a second embodiment of the invention, the base portion 10 provides a first fastener receiving means 60, consisting of threaded holes to receive nuts as are commonly known, and the upright portion 40 provides a second fastener means 65 consisting of nuts and a plate with corresponding holes 69 to receive nuts, as are commonly known. The first fastener receiving means 60 and the second fastener means 65 enable the upright portion 40 to be fastened to the base portion 10, as shown in FIGS. 4, 5, 6, and 8. Alternately, in the first embodiment of the invention, with the upright portion 40 comprising both a lower member 42 and an upper member 44, as shown in FIGS. 1, 2, the first fastener receiving means 60 consists of threaded holes to receive nuts, with the holes being drilled directly into the upper member 44 and the lower member 42, and the second fastener means 65 is comprised of nuts.

Figure 10:
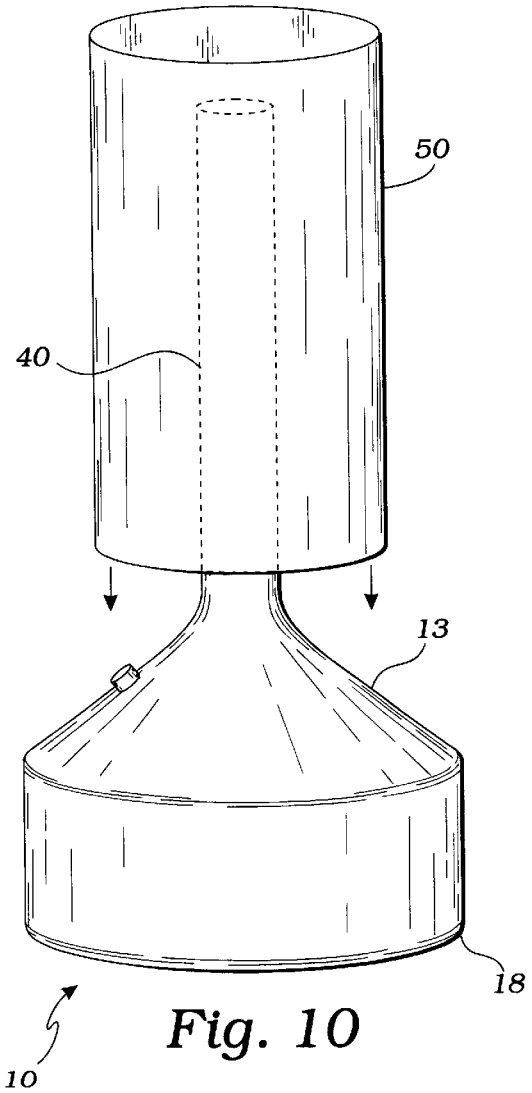
FIG. 10 shows a third embodiment of the invention where the base is integral with the upright elongate member.
Figure 11:
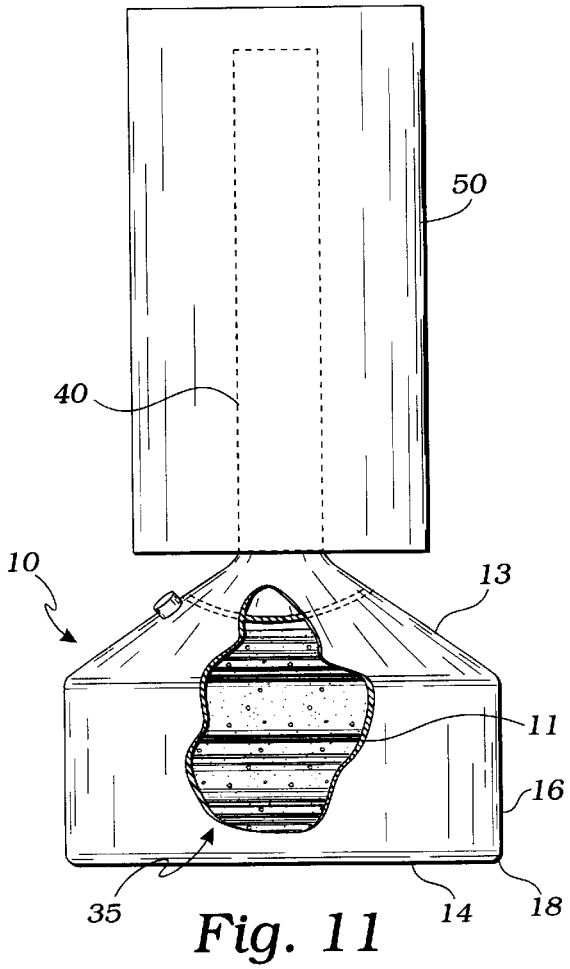
FIG. 11 is similar to FIG. 10, and shows a partial cutaway view.

In a third embodiment of the invention, a top plate 13 of the base portion 10 is formed integrally with the upright portion 40, as shown in FIGS. 10, 11.

The apparatus further comprises a cushion portion 50, preferably comprised of foam, removably engagable with the upright portion 40 and positioned in a vertical orientation for receiving hand or foot blows from an upright boxer or kickboxer.

Figure 6:
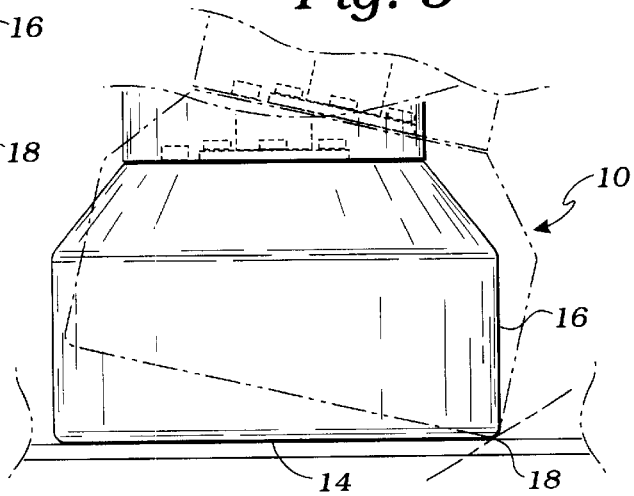
FIG. 6 is similar to FIG. 5 and shows a base as it would look after rotation following a kick or punch, and the base touching a floor surface at a radiused peripheral edge of the base.
Figure 7:
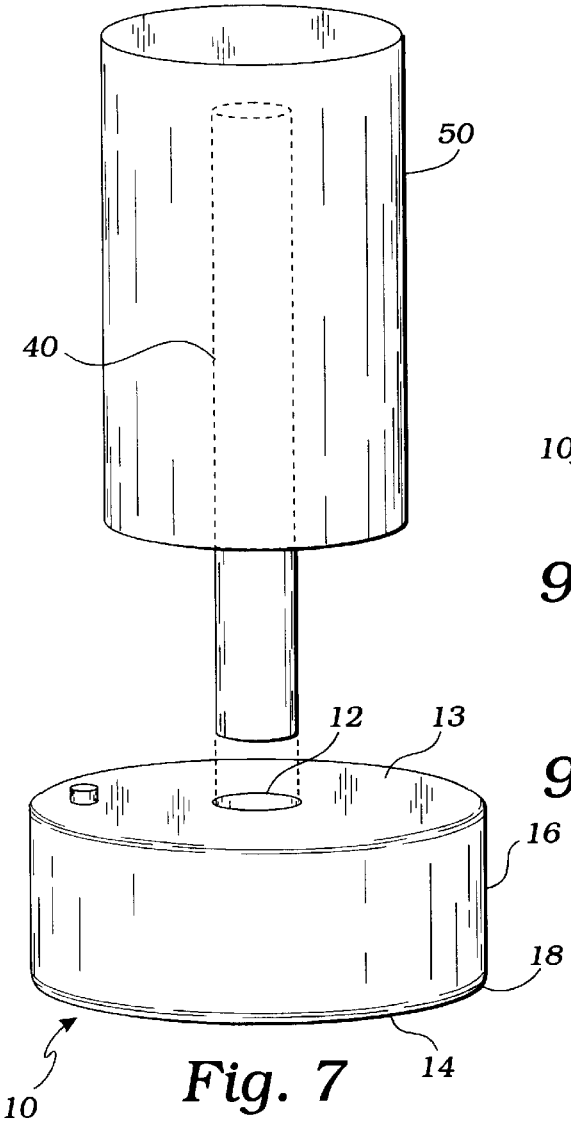
FIG. 7 is similar to FIG. 4, and shows the base without an upraised collar portion.
Figure 8:
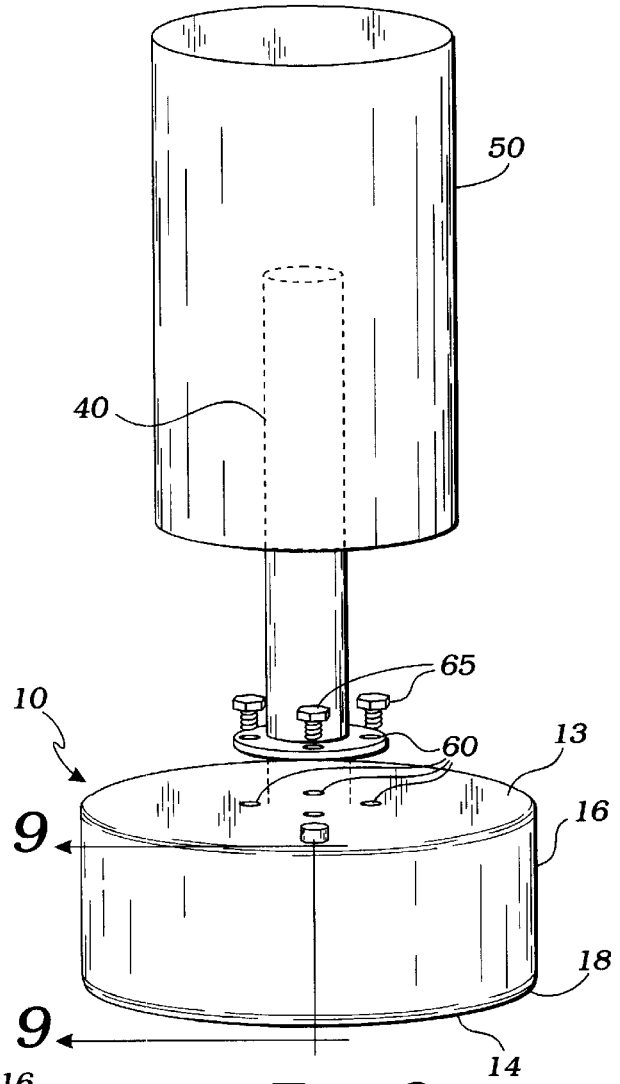
FIG. 8 is similar to FIG. 7 and shows a fastening means.
Figure 9:
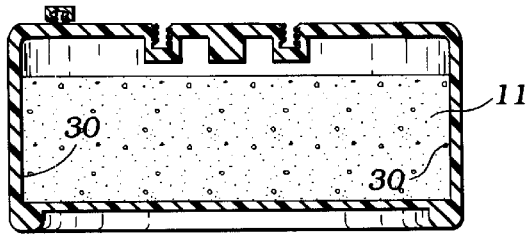
FIG. 9 is a sectional view along the plane shown in FIG. 8

The base portion 10 provides a circular base plate 14 for resting the apparatus on a surface such as a gym floor, and a circular sidewall 16, the circular sidewall 16 joining the circular base plate 14 in an outside radiused peripheral edge 18. Inventively, when the apparatus receives blows, the apparatus remains rigid and the base portion rotates about the outside radiused peripheral edge 18 so that when the boxer or kickboxer kicks or punches the bag, the resistance he or she feels is from the weight of the entire bag, including the filling material inside of the container base, as shown in FIGS. 6, 14.

Figure 12:
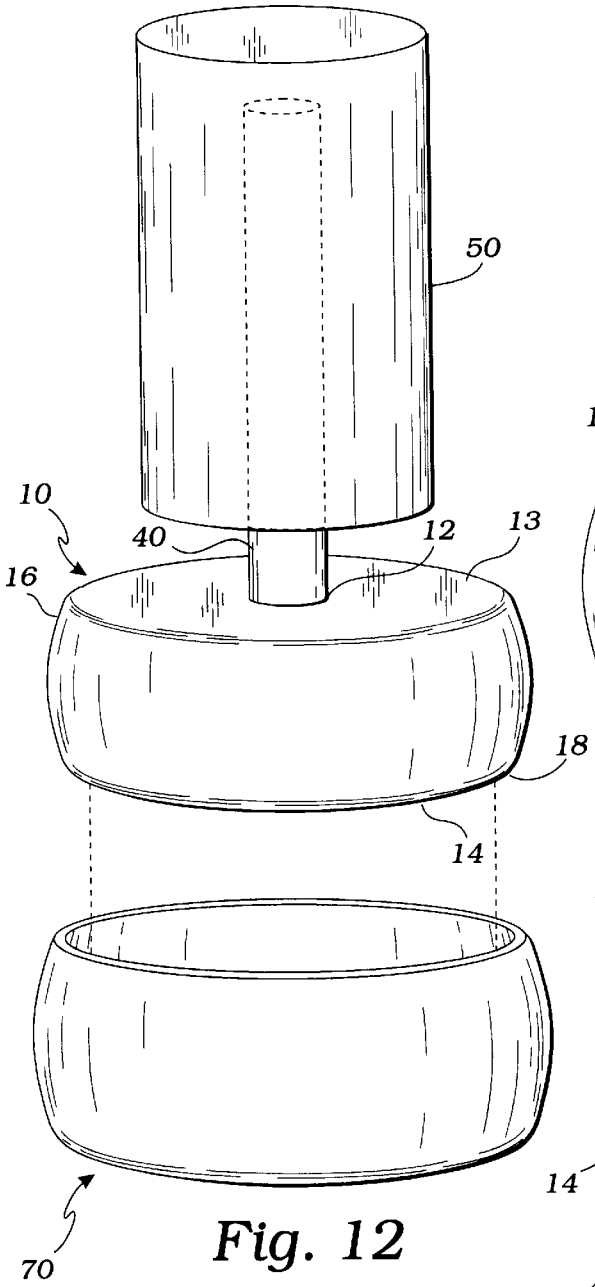
FIG. 12 is similar to FIG. 11, and shows a third embodiment with the base portion resting in and retained within a retainer portion.
Figure 13:
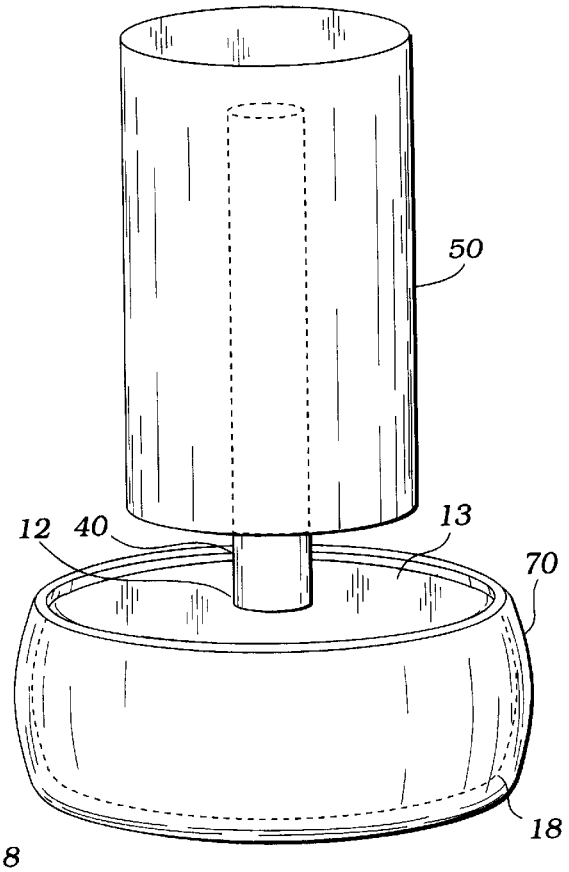
FIG. 13 is similar to FIG. 12.
Figure 14:
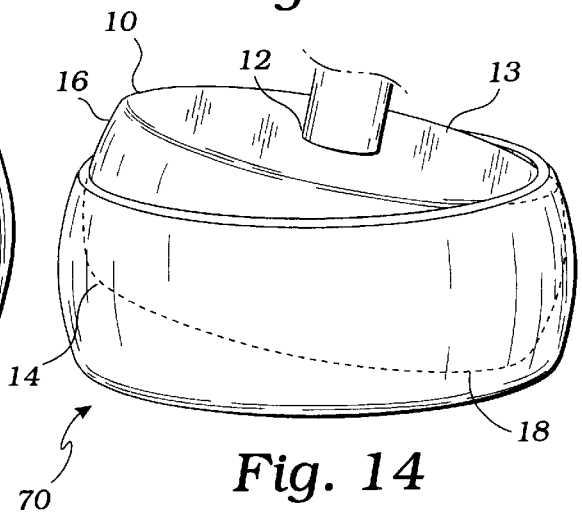
FIG. 14 is similar to FIG. 13, and shows the base portion rotated, or tilted up so that only a portion of the outside peripheral edge is touching the floor, and the base retained within the retainer portion.

In another embodiment, the base portion 10 provides a base peripheral sidewall 60 of circular formation with respect to the horizontal, and convex formation with respect to the vertical, the apparatus further comprising a cylindrical retainer portion 70 of circular formation with respect to the horizontal and convex formation with respect to the vertical, such that the base portion 10 rests within the retainer portion 70 and,is retained in place thereby, as shown in FIGS. 12–14. When the cushion portion 50 receives a blow, the base portion 10 rotates, or its surface tilts up so that only a portion of the radiused peripheral edge 18 is touching the floor, and the convex shape of the base portion 10 allows the base portion 10 to be rotated within the retainer portion 70 about the radiused peripheral edge 18 and to thereafter right itself due to the force of gravity, as shown in FIG. 14.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for kick boxing training, the apparatus comprising:

a base portion providing a centrally positioned vertical through hole;

an upright cylindrical portion providing a flange at one end thereof, the upright portion engaged within the through hole of the base portion, the flange positioned below the through hole and enabled for retaining the upright portion within the base portion;

a cushion portion removably engaged with the upright portion, the cushion portion receiving the upright portion therein; and the base portion providing a circular base plate for resting the apparatus on a surface, and a circular sidewall, the sidewall joining the base plate in an outside radiused peripheral edge for the apparatus to rotate about when moved off the vertical by a blow to the cushion portion.

2. The apparatus of claim 1 wherein the upright cylindrical portion comprising a pair of tubes with one of the tubes engagable within the other of the tubes.

3. An apparatus for kick boxing training, the apparatus comprising: a base portion providing a means for increasing the weight of the base portion; an upright portion removably and fixedly engagable with the base portion; a cushion portion removably engagable with the upright portion and positioned for receiving hand and foot blows from an upright boxer; the base portion providing a circular base plate for resting the apparatus on a surface, and a circular sidewall the sidewall joining the base plate in an outside radiused peripheral edge enabled such that a blow received by the cushion portion causes the apparatus to rotate about the radiused peripheral edge and to thereafter right itself.

4. The apparatus of claim 3 wherein the upright portion comprises a lower member adapted for engaging a through hole in the base portion for engagement therewith, and an upper member engaged with the lower member for providing a vertical extension.

5. The apparatus of claim 3 wherein the weight increasing means is a base portion interior surface defining a storage space for receiving a ballast.

6. The apparatus of claim 3 wherein the upright portion comprises an elongate member adapted for engaging a through hole in the base portion for engagement therewith, and further adapted for extending vertically above the base portion for receiving the cushion portion.

7. The apparatus of claim 3 wherein the base portion provides first fastener receiving means and the upright portion provides second fastener means for enabling the upright portion to be fastened to the base portion.

8. The apparatus of claim 3 wherein a top plate of the base portion is formed integrally with the upright portion.

9. The apparatus of claim 3 wherein the base portion provides a base peripheral sidewall of circular formation with respect to the horizontal and convex formation with respect to the vertical, the apparatus further comprising a cylindrical retainer portion of circular formation with respect to the horizontal and convex formation with respect to the vertical such that the base portion rests within the retainer portion and is retained in place thereby, the base portion enabled for rotation within the retainer portion when the cushion portion receives a blow.

* * * * *